US011925837B2

(12) United States Patent
Chuah

(10) Patent No.: US 11,925,837 B2
(45) Date of Patent: Mar. 12, 2024

(54) ABDOMINAL EXERCISE ROLLER

(71) Applicant: Khai Gan Chuah, Austin, TX (US)

(72) Inventor: Khai Gan Chuah, Austin, TX (US)

( * ) Notice: Subject to any disclaimer, the term of this patent is extended or adjusted under 35 U.S.C. 154(b) by 194 days.

(21) Appl. No.: 17/497,786

(22) Filed: Oct. 8, 2021

(65) Prior Publication Data

US 2023/0112877 A1 Apr. 13, 2023

(51) Int. Cl.

| | |
|---|---|
| ***A63B 22/20*** | (2006.01) |
| ***A63B 21/00*** | (2006.01) |
| ***A63B 21/005*** | (2006.01) |
| ***A63B 23/02*** | (2006.01) |
| ***A63B 24/00*** | (2006.01) |

(52) U.S. Cl.

CPC ..... *A63B 22/203* (2013.01); *A63B 21/0004* (2013.01); *A63B 21/0058* (2013.01); *A63B 23/0205* (2013.01); *A63B 24/0062* (2013.01)

(58) Field of Classification Search

CPC ..... A63B 22/203; A63B 21/0004; A63B 21/0058; A63B 23/0205; A63B 24/0062

See application file for complete search history.

(56) References Cited

U.S. PATENT DOCUMENTS

2021/0394011 A1* 12/2021 Neuhaus ..... A63B 21/151

FOREIGN PATENT DOCUMENTS

| | | | | |
|---|---|---|---|---|
| CN | 106139529 A | * | 11/2016 | ..... A63B 21/00 |
| CN | 110354453 A | * | 10/2019 | ..... A63B 22/203 |
| CN | 210933604 U | * | 7/2020 | |

* cited by examiner

*Primary Examiner* — Sundhara M Ganesan

*Assistant Examiner* — Jacqueline N L Loberiza

(74) *Attorney, Agent, or Firm* — Craige Thompson; Timothy D. Snowden; Thompson Patent Law

(57) ABSTRACT

An abdominal exercise roller with a powered wheel mechanism to assist the user during the abdominal exercise routine. The invention includes utilizing sensing technology and the electronic module to control the motor and optimize the performance of the abdominal roller during the exercise routine.

18 Claims, 12 Drawing Sheets

ABDOMINAL EXERCISE ROLLER

BACKGROUND OF THE INVENTION

Field of the Invention

The present invention is an abdominal exercise roller with a powered wheel mechanism to assist the user during the abdominal exercise routine. The invention includes utilizing sensing technology and the electronic module to control the motor and optimize the performance of the abdominal roller during the exercise routine.

Discussion of Prior Art

The conventional abdominal roller is a wheel with two handles on the sides that require the user's strength to control the forward and backward movement of the roller during the core exercise routine. It often causes a user to overstretch and reach a point beyond his capability to retract the roller back to its starting position. Another drawback to this type of roller is that it may roll out too fast for the user to control if used on a smooth floor surface with little friction. The improved version of abdominal rollers uses coil springs to provide resistance and restore forces. The spring would be coiled as the user pushes forward and released when the user retracts, thus generating restoring energy after moving forward to the desired position, aiding the pulling back motion of the exercise. Even though helpful, the spring-loaded method only allows a constant force of assistance to the user within a limited traveled distance. The output force of the coiled spring cannot be adjusted, modified, or quantified. This limits the ability of a user to adjust, gauge, set goals, and record their progress.

SUMMARY OF INVENTION

The present invention is an abdominal exercise roller with a powered wheel mechanism to assist the user during the abdominal exercise routine. The powered wheel mechanism utilizes a built-in electric motor and gear set to drive the abs roller at the desired speed. The targeted major muscles of the core reside in the area of the belly, which are stretching and contracting during the use of the roller. During the contracting phase, the powered roller will be activated to assist the user in driving the roller back to the starting position of the exercise. The powered roller can also be activated and deactivated by the user, preset by the factory, or by using sensing technology to adjust and control the operation of the powered wheel mechanism. The roller will also have the wireless transmission of information received and recorded to an electronic device such as a smartphone or tablet to record, adjust settings, and monitor progress with the wireless network technology.

BRIEF DESCRIPTION OF INVENTION

DETAILED DESCRIPTION OF THE INVENTION

Figure 1:
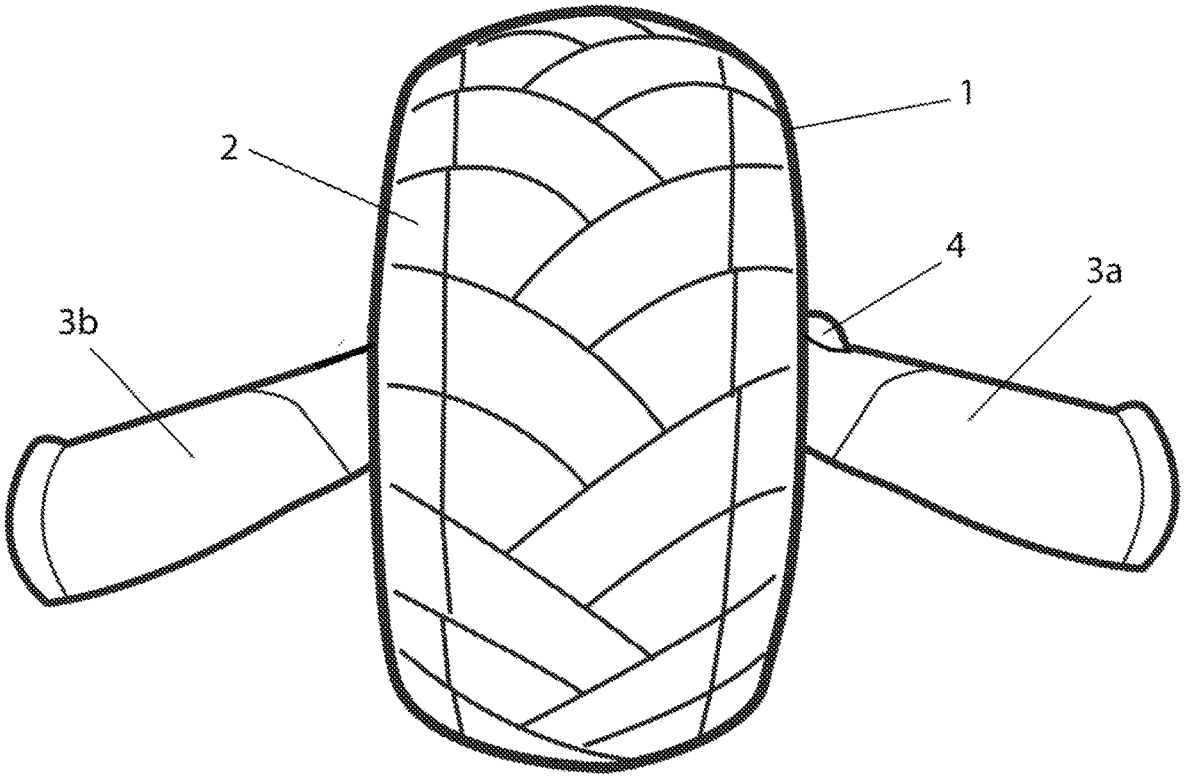
FIG. 1 is a front view of the abdominal roller according to an embodiment of the present invention.

The present invention is a powered abdominal roller 1; an abdominal exercise roller comes with the powered wheel mechanism to assist the user during the abdominal exercise routine (see FIG. 1). The powered wheel mechanism drives the abdominal roller at the desired speed by utilizing a built-in electric motor 18 and gear set 19 (discuss hereafter). The powered driven wheel is helpful to user who does not have the adequate muscle strength to retract the abdominal roller 1 from the extended position. When the user extends beyond his capability to retract the abdominal roller, the powered driven wheel will assist the user in returning to the original position and allow the user's own strength to continue the exercise routine. As illustrated in FIG. 1, the abdominal roller 1 consists of a wheel 2 and handles 3*a* and 3*b*, mounted on each side of said abdominal roller 1. During a body core muscles exercise routine, the user holds on to the handles 3*a* and 3*b* of the abdominal roller 1. The body core muscles are perceived to stretch and contract through a full range of back and forth motions. The targeted major muscles of the core reside in the area of the belly.

Figure 2A:
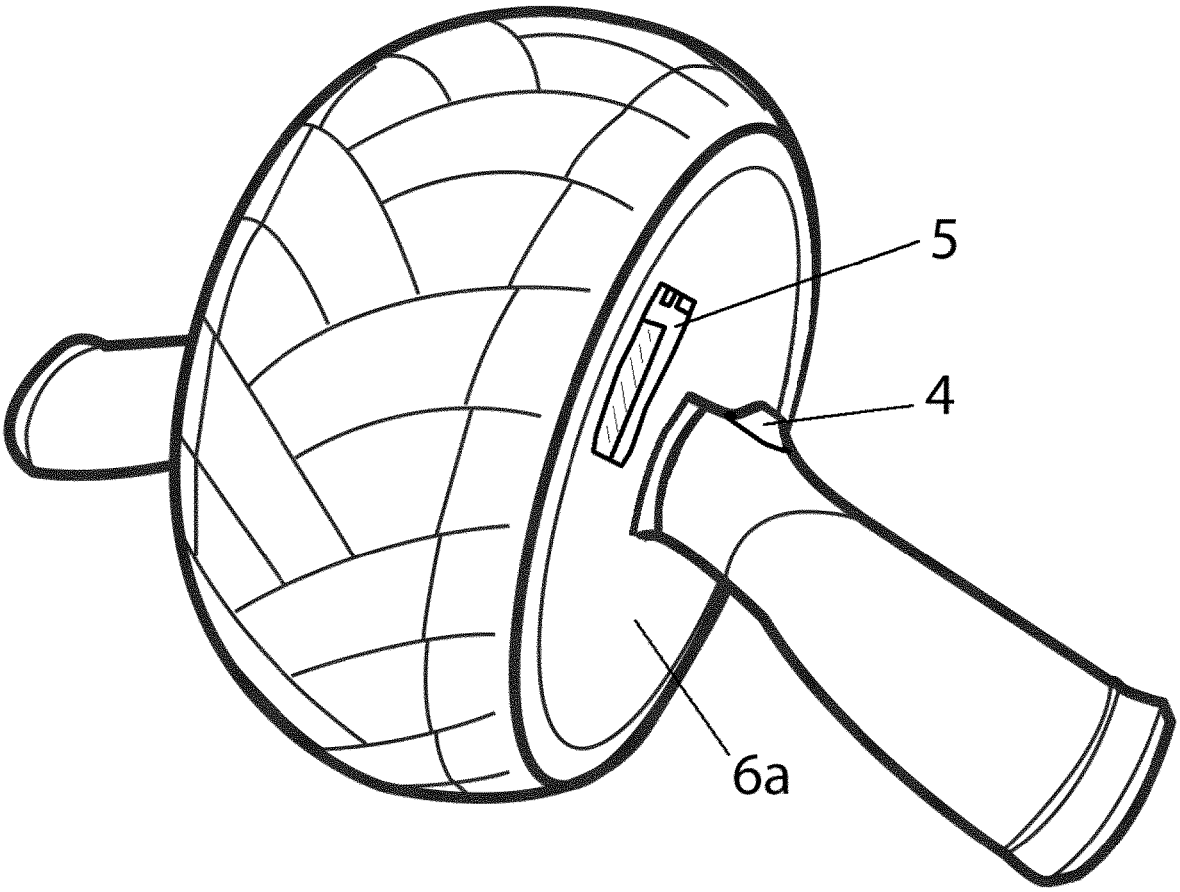
FIG. 2A and FIG. 2B is a right perspective view of the abdominal roller with the switch and interface control panel, and with a voice-recognition device and interface control panel, respectively.
Figure 3:
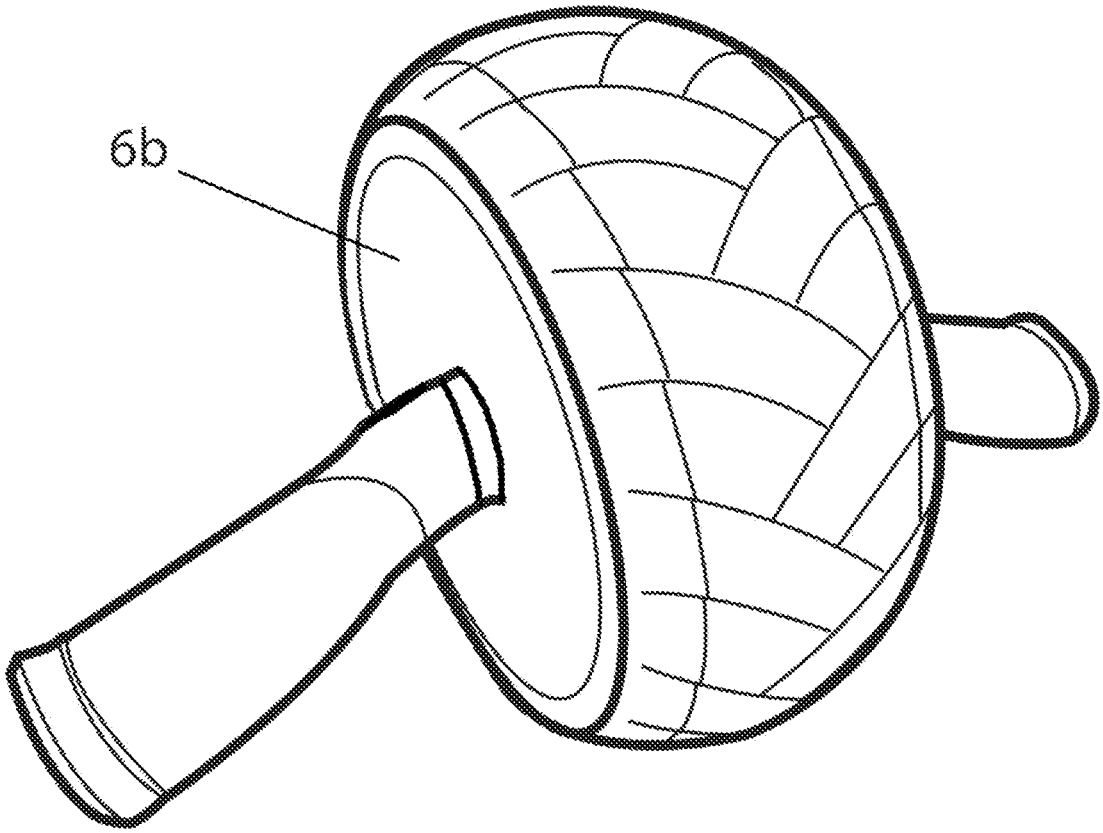
FIG. 3 is a left perspective view of the abdominal roller.
Figure 4:
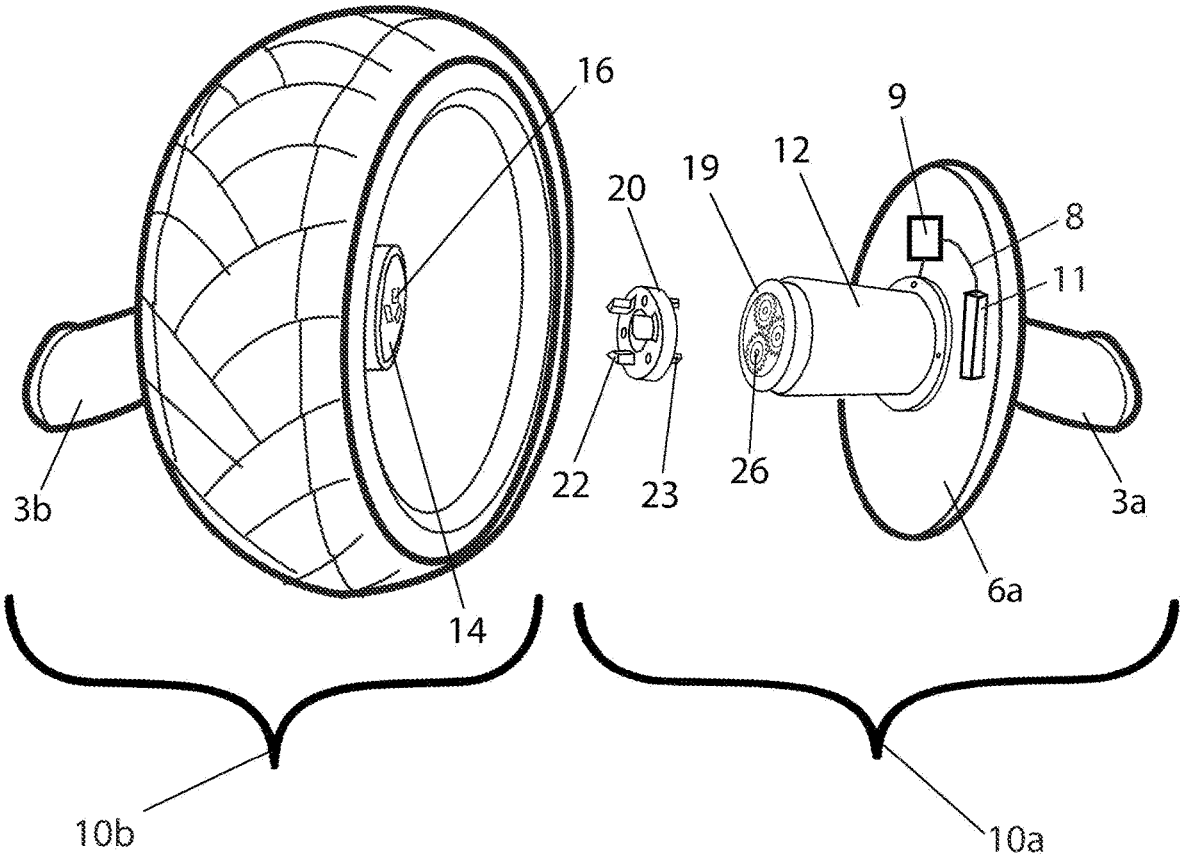
FIG. 4 is an exploded view of the inner components of the abdominal roller.

The handles 3*a* and 3*b* are of a shaft shape, proper for hand grip. The handles 3*a*, 3*b* are attached to the panel 6*a*, 6*b* respectively (see FIG. 2 and FIG. 3). As illustrated in FIG. 4, the main structure of the abdominal roller 1 consists of right member 10*a* and left member 10*b*. The right member 10*a* consists of handle 3*a*, and panel 6*a*. Panel 6*a* consists of main parts such as gear component (discuss hereafter) and support base 12. While other parts such as battery 11, electronic module 9, and interface control panel 5 can be placed anywhere without restriction as desired as long as it is without obstructing the operation of abdominal roller 1. The left member 10*b* consists of wheel 2, handle 3*b*, and panel 6*b*. Panel 6*b* further includes a wheel hub 14, with means to couple with support base 12 from right member 10*a*. The support base 12 may act as an axle coupling both members 10*a* and 10*b* to form the complete abdominal roller 1. The support base 12 is a hollow cylinder drum that holds the gear component in position. It is to be noted, the panel 6*a*, 6*b* can also be part of the wheel itself.

Figure 7:
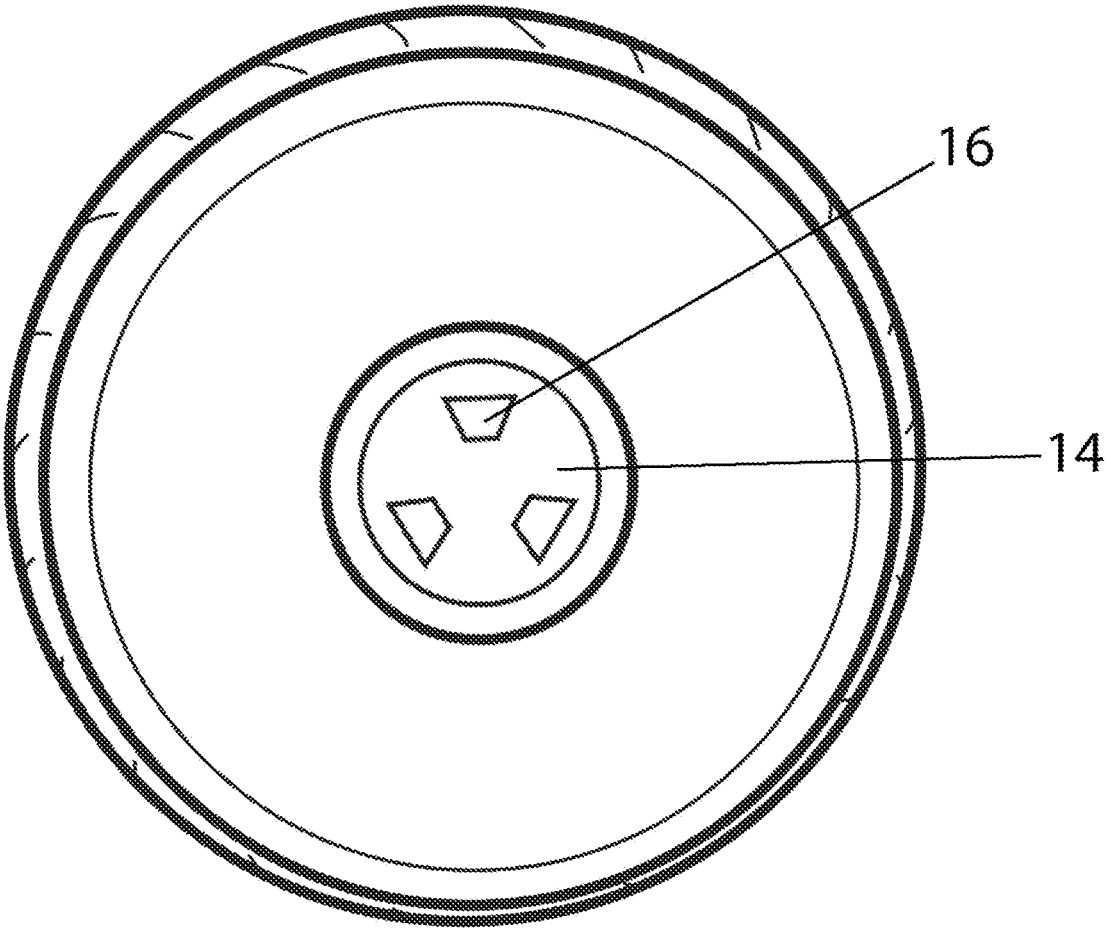
FIG. 7 is a cross-sectional view of the wheel showing the wheel hub.

The gear component includes an electric motor 18, and a gear set 19. The rotating cap 20 is a circular disc consisting of a lower tab(s) 23 and output shaft(s) 22. The output shaft(s) 22 is to engage with the socket(s) 16 of wheel hub 14 (see FIG. 4 and FIG. 7) and rotate the wheel 2, while the lower tab(s) 23 is to engage the eyelets 26 of the gear set 19. The rotating cap 20 can be of various designs, sizes, types, and shapes. The rotating cap 20 can be also part of the gear component, gear set, or the electric motor itself as one entity.

Figure 5:
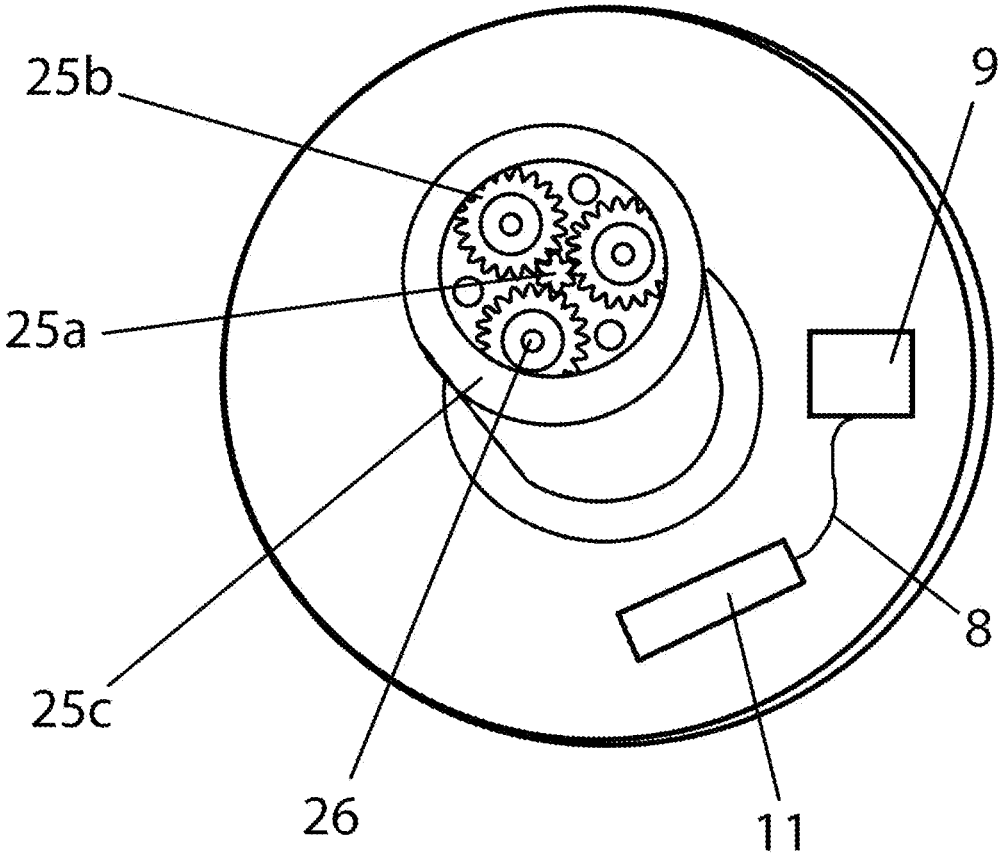
FIG. 5 is a top perspective view of the support base of the abdominal roller exposing the components.
Figure 6:
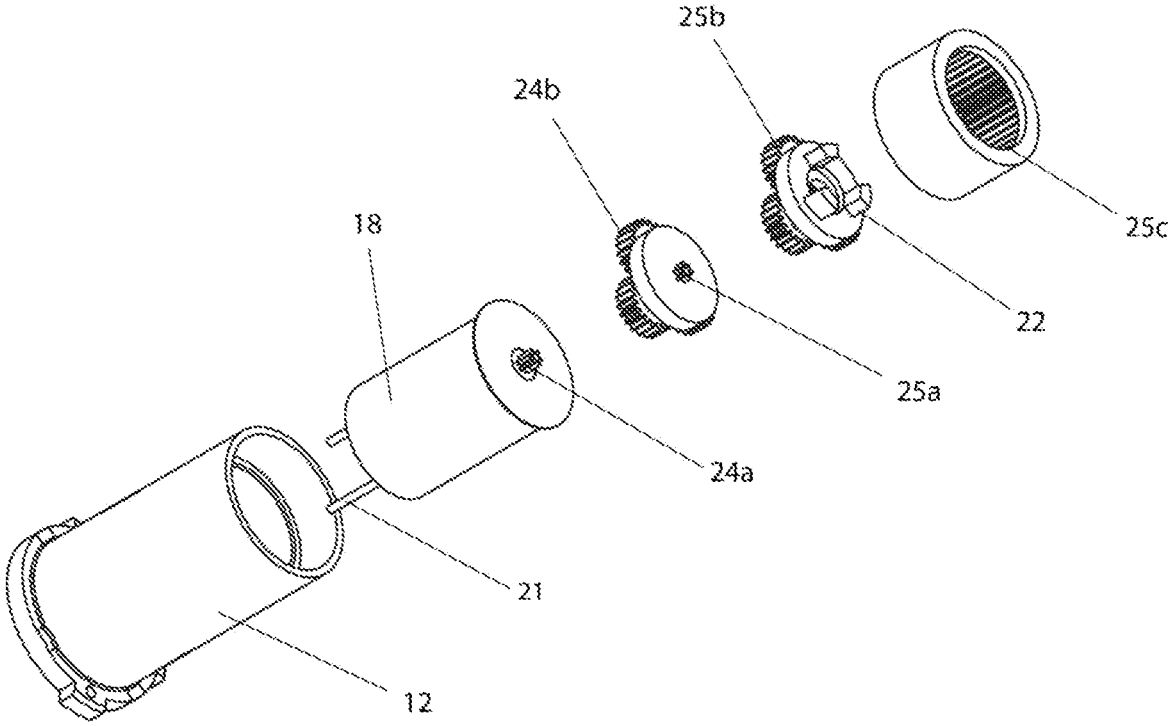
FIG. 6 is an expanded view of the components within the support base of the abdominal roller.

The gear set 19; in this case, a planetary gear set comprises several gear components: input gear 24*a*, center gear 25*a*, planet gears 24*b*, 25*b*, and ring gear 25*c* (See FIGS. 5 & 6).

FIG. 6 depicts the shaft of electric motor 18 is connected to input gear 24*a*. When the electric motor 18 is energized, the input gear 24*a* triggers the rest of the gears, which further rotates the output shaft(s) 22. The electric motor 18 is powered from battery 11 via input 21. Battery 11 connects to electronic module 9 and electric motor 18 via a wiring system 8 (see FIG. 4). The output shaft(s) 22 of right member 10*a* engages with the socket 16 of wheel hub 14 of left member 10*b* to work in synchrony to drive the wheel 2 of the abdominal exercise roller 1 at the desired speed. The output shaft(s) 22 can also be of one single shaft to engage with one single socket of the wheel hub 14.

In an exercise routine, the user first places the abdominal roller 1 on the floor. During the stretching phase, the user begins by placing himself in a quadruped position with the abdominal roller 1 under his shoulders and hands gripping the handles 3*a*, 3*b*. When the user rolls forward, his abdominal muscles lengthen as gravity force drives the forward motion. The user may hold the position for several seconds when he reaches his maximum extended position or "rolled out" pose.

During the contracting phase, the user may engage the powered wheel mechanism to assist the movement.

It is to be noted that the gear set 19 can be any gear as long as it achieves the same result as the above. The gear component can also be housed in the handle of the abdominal roller 1. In this case, the handle of the abdominal roller is the support base which may consist of an electric motor, gear set, and/or battery. The output shaft at the end of the handle further engages with the wheel hub and drives the wheel of abdominal roller. It is to be noted that the drum of support base 12 can also hold other components in a position not limited to electric motor 18 and/or gear set 19.

The components of right and left members 10*a* and 10*b* such as the wheel 2, handle 3*a* and 3*b*, panel 6*a* and 6*b*, support base 12, the rotating cap 20, output shaft 22, lower tab 23, electric motor 18, gear set 19 and wheel hub 14, socket 16 can be of various designs, sizes, types, shapes and combinations as long as it achieves the same result as above.

The speed of the abdominal roller 1 can be optionally adjusted by the speed controller (not shown). The speed controller is a circuit device that controls the speed of motors, and it can be part of electronic module 9. The electric motor 18 is connected to the speed controller to run the roller at the desired speed. The speed controller may have several settings such as level 1, level 2, or level 3 to speed up or slow down the wheel's rotation speed.

The powered wheel mechanism can also be designed of mechanical elements driven by the motor to engage further and drive the wheel. The mechanical elements can be in the form of but are not limited to the belt, chain, cable, clutch, gear train, cam, and follower systems, linkage, and simple machines. The motor can be placed anywhere within the abdominal roller without restriction as desired as long as it engages and drives the mechanical elements without obstructing the operation of the abdominal roller.

According to one illustrative embodiment, the powered wheel mechanism can be activated/deactivated by a powered wheel trigger. Powered wheel trigger comes in manually operated and sensing technology (discuss hereafter). Switch 4 is an example of a manually operated powered wheel trigger. The user may press switch 4 located on the handle's shaft on the abdominal roller 1 (see FIG. 1) to activate/deactivate the electric motor 18 of the abdominal roller 1. Switch 4 is connected to the electronic module 9, which is further connected to battery 11 via wire 8. Switch 4 must be turned "ON" to form a complete circuit to actuate the powered wheel mechanism. Powered by battery 11, electric motor 18 activates and rotates its gears at the gear set 19, which further causes the output shaft(s) 22 to move in a circular motion, which drives the wheel 2 forward and/or backward.

The configuration setting in the electronic module 9 determines the operation of the powered wheel mechanism, either preprogrammed in the factory and or set by the user via interface control panel 5 or through, as applicable, a web browser(s) and/or mobile web apps on a computer and/or smart device. The electronic module 9 may consist of a microprocessor embodied as a microchip and include associate storage elements for storing various system parameter data. There is no limitation in configuration setting; the electronic module 9 may be customized to set a wide range of powered wheel operations based on the user's need, such as a single-clicking on switch 4 to rolling forward or backward, and a double-clicking to add resistance by reversing the wheel rotation against the forward motion, etc. It is to be noted that the manually operated powered wheel mechanism is not limited to the activated or deactivated motion, It can be designed to work with other devices, such as sensing technology (discuss hereafter) if deemed necessary or desired. Switch 4 is optimally placed along the shaft of one handle so that it is at a position where it can be easily activated and deactivated by a finger of the user's hand while gripping the handle. Switch 4 can be of various designs, sizes, types, and shapes, such as a lever, as long as it achieves the same result. It is to be noted, switch 4 can also be placed anywhere within the abdominal roller as long as the user can reach it.

Figure 2B:
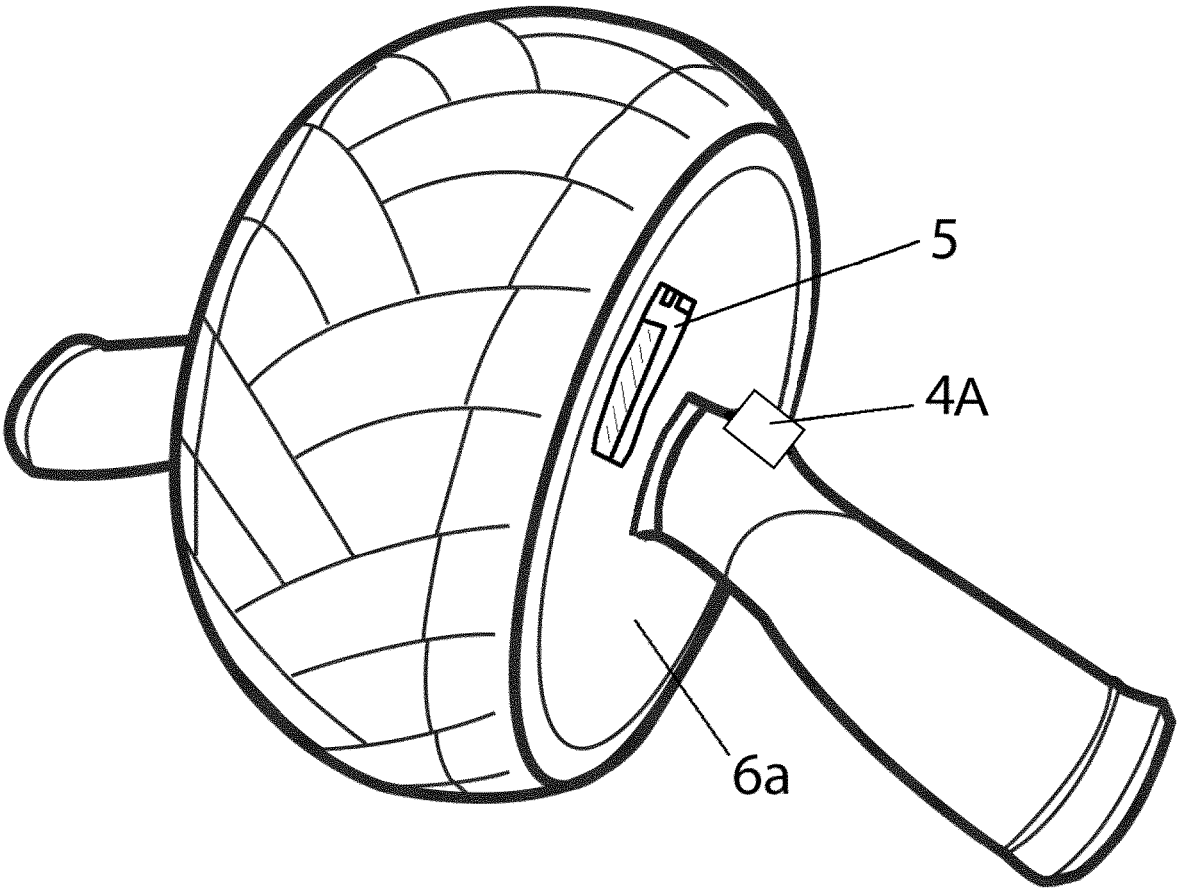

The abdominal roller 1 can be designed with voice-recognition capabilities to control the powered wheel mechanism. In this case, as shown in FIG. 2B, switch 4 is replaced by a voice-recognition device 4A (e.g., microphone device). The microphone is connected to the electronic module 9, together form a voice-recognition powered wheel trigger which is further connected to battery 11 via wire 8. The user may use the voice command to manually activate/deactivate the electric motor 18 of the abdominal roller 1.

Figure 8:
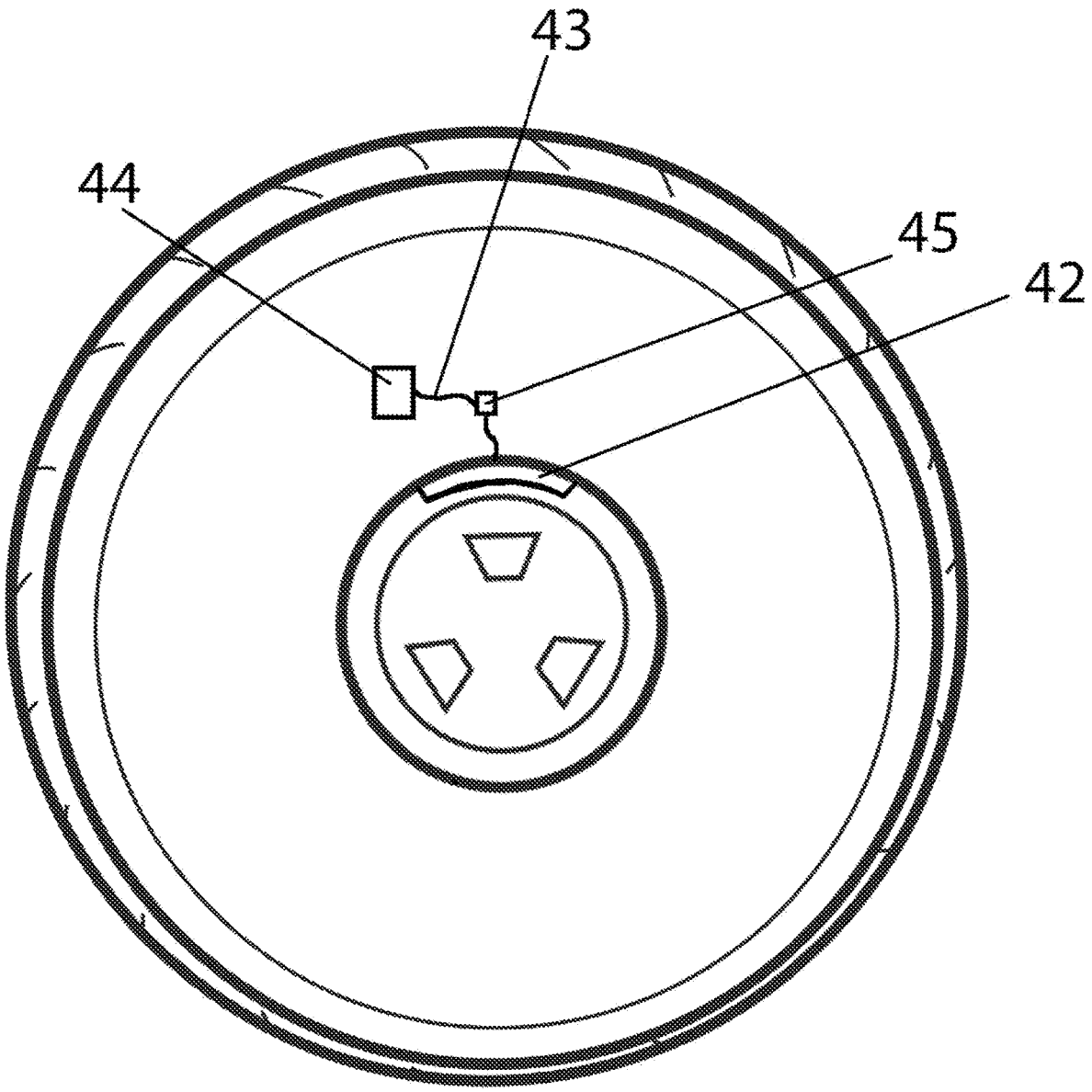
FIG. 8 is a cross-sectional view of the wheel showing the wheel hub and motion direction sensor.

The powered wheel trigger can also be in the form of sensing technology. Sensing technology uses sensors to acquire information by detecting the physical or biological property quantities and converting them into readable signals. The sensors include but are not limited to motion, stress, or biosensor. The configuration setting in the electronic module 45 (see FIG. 8) determines the operation of the powered wheel mechanism, either preprogrammed in the factory and or set by the user via interface control panel 5 or through, as applicable, a web browser(s) and/or mobile web apps on a computer and/or smart device. The electronic module 45 may consist of a microprocessor embodied as a microchip and include associate storage elements for storing various system parameter data. There is no limitation in configuration setting; the electronic module 45 may be customized to set a wide range of powered wheel operations such as rolling forward, rolling backward, free rotation, set distance, set direction, or set rolling time, etc.

In this embodiment, a motion direction sensor 42 is placed in proximity to wheel hub 14 to detect the direction of rotation of the wheel. The motion direction sensor 42 is connected to the electronic module 45, which is powered by battery 44 via wire 43. During the stretching phase, the abdominal roller may be driven and guided by the user on the handles 3*a*, 3*b*. In the contracting phase, the user initiates the powered wheel mechanism by pulling the abdominal roller toward his body. In this case, the wheel is rotating in the reverse direction. The motion direction sensor 42 detects a change in the direction of the rotation, captures and sends the signal to the electronic module 45. The electronic module 45 executes the instructions to actuate the powered wheel mechanism, which further mobilizes the motor to drive toward the user. It is to be noted that the motion direction sensor 42 is not limited to detecting the motion in one direction. It can be designed in many combinations of directions if deemed necessary or desired. For example, the electronic module 45 may be programmed for the sensor 42 to detect only the backward wheel's rotation.

The abdominal roller can operate in adaptive mode by controlling the powered wheel mechanism based on the real-time condition. The adaptive mode variables such as speed, resistance, or other attributes may be programmed into electronic module 45 in the factory and or set by the user via interface control panel 5 or through, as applicable, a web browser(s) and/or mobile web apps on a computer and/or smart device. The adaptive mode variables may act as reference points for electronic module 45 to adjust and fine-tune its operation accordingly. For example, if the user's motion is slower than the desired speed value in the adaptive mode for speed, the electronic module 45 executes the instructions to accelerate automatically. Similarly, the abdominal roller decelerates if the motion is faster than the desired value.

Figure 9:
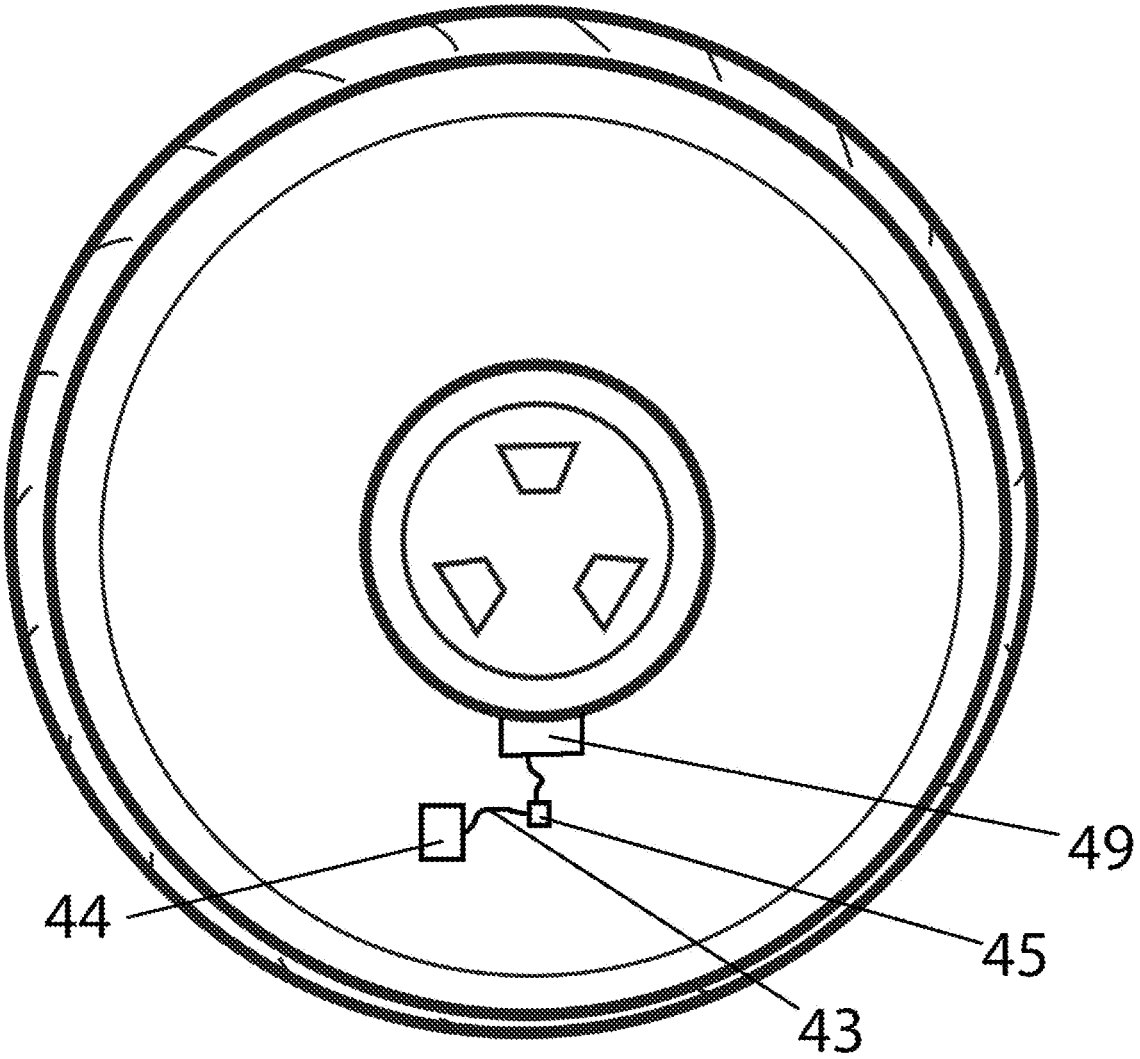
FIG. 9 is a cross-sectional view of the wheel showing the wheel hub and force sensitive sensor.

FIG. 9 depicts a force-sensitive sensor is placed in proximity to wheel hub 14. The force-sensitive sensor 49 is connected to the electronic module 45, which is powered by battery 44 via wire 43. Force-sensitive sensor 49 detects and sends out a signal when an external force, pressure, or mechanical stress is applied and detected on the abdominal roller. The configuration setting in the electronic module 45 determines the operation of the powered wheel mechanism, either preprogrammed in the factory and or set by the user via interface control panel 5 or through, as applicable, a web browser(s) and/or mobile web apps on a computer and/or smart device. The electronic module 45 may be programmed to deactivate the powered wheel mechanism when no external force is detected by force-sensitive sensor 49.

Figure 10:
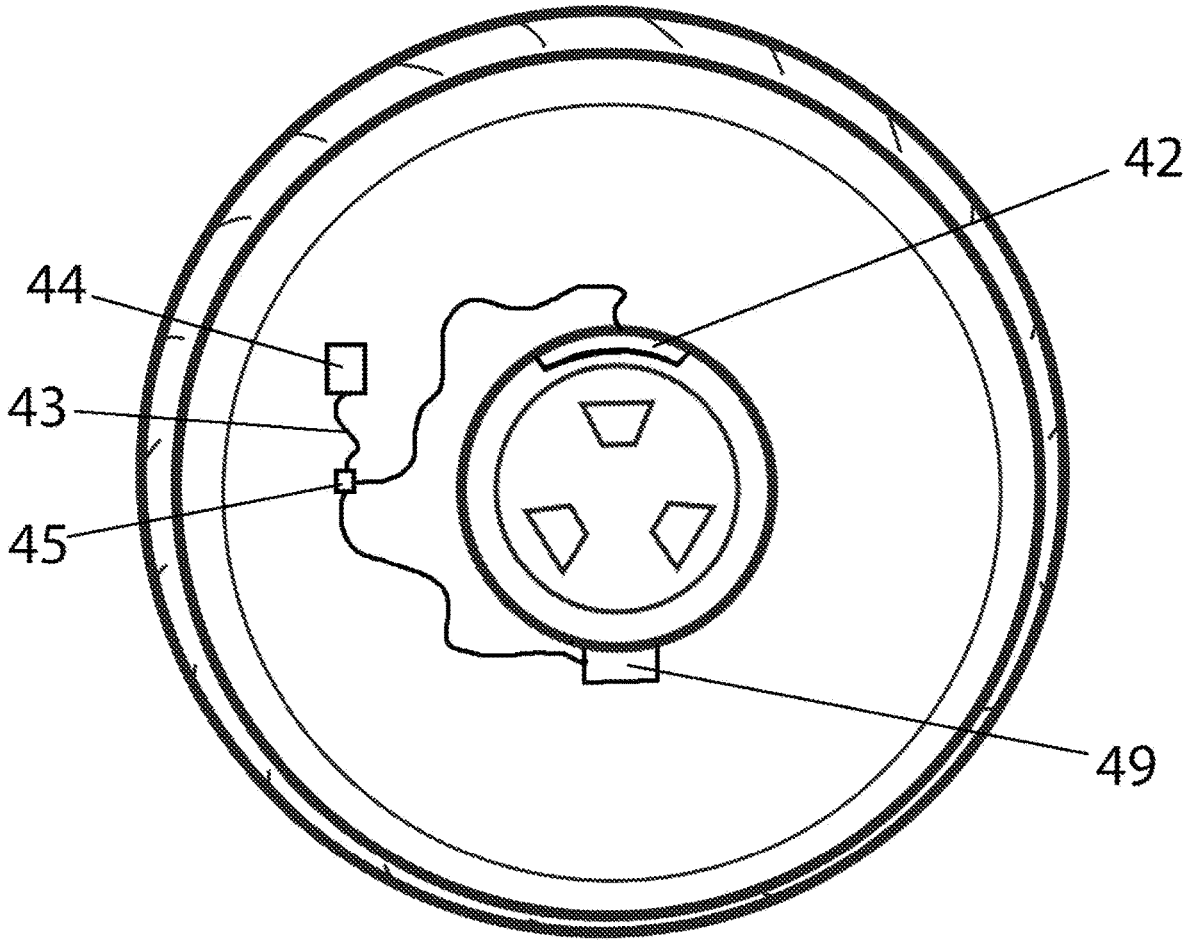
FIG. 10 is a cross-sectional view of the wheel showing the wheel hub, motion direction sensor, and force sensitive sensor.

For abdominal roller equipped with manually activated/deactivated feature, the force-sensitive sensor 49 ensures the abdominal roller 1 will not turn on unexpectedly when the user accidentally presses the switch 4. For abdominal roller is equipped with a sensor that interacts with a powered wheel mechanism, such as motion direction sensor 42 (see FIG. 10). During the contracting phase, the motion direction sensor 42 detects a change in the rotation direction of the wheel, captures and sends the signal to the electronic module 45, which further actuates the motor 18 to drive the roller towards the user. Suppose the user does not assert adequate force on the abdominal roller, such as when he does not grip on the handles well; in this instance, the force-sensitive sensor 49 will stop the motor immediately to prevent the abdominal roller from further rolling or simply deactivated the powered wheel mechanism.

Figure 11:
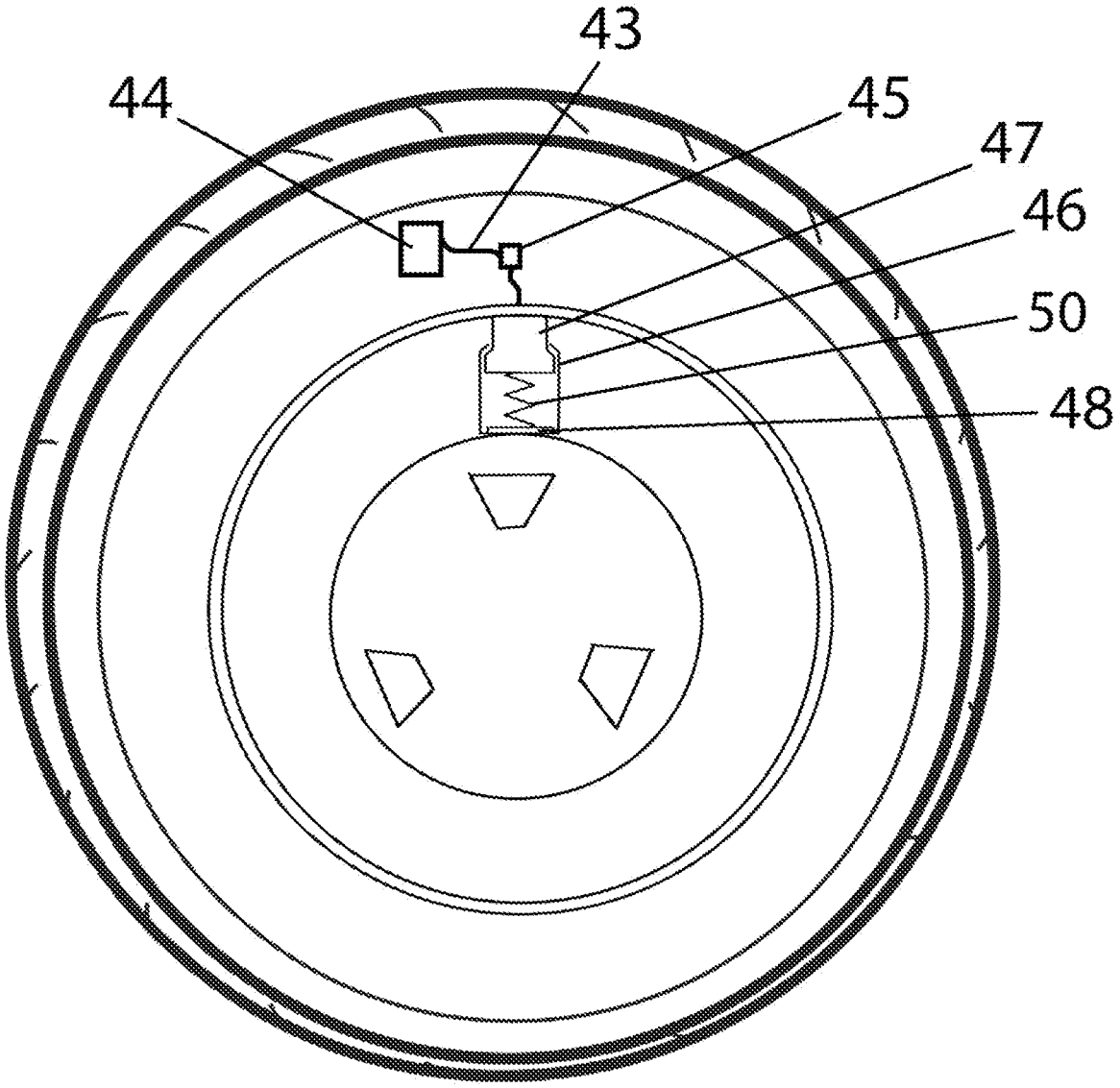
FIG. 11 is a cross-sectional view of the wheel showing the wheel hub and the mechanical sensing device.

A mechanical sensing device, such as depicted with respect to elements 46-50, for example, can also be used to replace the force-sensitive sensor. A mechanical tension-loaded component such as a spring-loaded switch is connected to the electronic module 45, powered by battery 44 via wire 43 (see FIG. 11). The spring-loaded switch 46 consists of a plunger 47, an end cap 48, and a spring 50. The spring-loaded switch 46 is placed near the wheel hub 14. The force asserted on the abdominal roller by the user during the abdominal exercise will retract the spring. Eventually, its conductive plunger 47 comes into contact with the conductive end cap 48 to form a complete circuit to actuate the powered wheel mechanism.

The powered driven wheel can be designed to include the utilization of a biosensor, whereby it learns to react and adapt its behavior accordingly to any input sensed, but not limited to, the user's vital signs, strength, force, or speed. The operation of the abdominal roller can be designed with real-time health and fitness biosensor to track the user's activity during the exercise routine. The biosensor may be positioned on the handles of the abdominal roller or any optimal placements on the roller or the user to collect data. During the exercise routine, the electronic module continuously scans vital parameters to detect heart health conditions and transmits data via wireless transmission of information received and recorded to an electronic device such as a smartphone or tablet to record, adjust settings, monitor progress. This feature will help improve the overall fitness of the user.

In addition, the data collected via biosensor may be processed by the electronic module to adjust and control the operation of the powered wheel mechanism. For example, suppose the heart pulse rate detected is high (above threshold), the electronic module may halt the operation of the abdominal roller, set the wheel free or alert the user to rest to prevent a heart attack. The biosensor may work with other sensors such as motion direction sensors and force-sensitive sensors to optimize the operation of the powered wheel mechanism. The movement of the abdominal roller driven by an electric motor can be customized based on the user's real-time condition.

It is to be understood that the invention is not limited in its application to the details of construction and the arrangement of the components set forth in the following description and illustrated in the drawings. The invention is capable of other embodiments or being practiced or carried out in various ways. Also, it is to be understood that the phraseology and terminology employed herein is for description and should not be regarded as limiting.

The invention claimed is:

1. An abdominal roller comprising:

(a) at least one wheel;

(b) at least one handle, wherein said at least one handle further connected to a side of said at least one wheel;

(c) at least one electrical power source;

(d) at least one electric motor, wherein at least electric motor connect to said least one electrical power source;

(e) at least one gear set, wherein said at least one electric motor engages with said at least one gear set;

(f) at least one electronic module, wherein said at least one electronic module controls the operation of said electric motor; and (g) at least one support base, wherein the at least one support base is coupled to the at least one wheel, the at least one support base is hollow and encases at least one gear set, the at least one gear set drives the at least one wheel between a first and a second position, wherein said at least one support base is an axle.

2. The abdominal roller according to claim 1, wherein at least one trigger interacts with said electronic module.

3. The abdominal roller according to claim 2, wherein said at least one trigger is a switch.

4. The abdominal roller according to claim 2, wherein said at least one trigger is a mechanical sensing device.

5. The abdominal roller according to claim 2, wherein said at least one trigger is a sensor.

6. The abdominal roller according to claim 5, wherein said at least one trigger is a motion direction sensor.

7. The abdominal roller according to claim 5, wherein said at least one trigger is force sensitive sensor.

8. The abdominal roller according to claim 2, wherein said at least one trigger is voice-recognition device.

9. An abdominal roller comprising:

(a) at least one wheel;

(b) at least one handle, wherein said at least one handle further connected to a side of at least one wheel;

(c) at least one electrical power source;

(d) at least one electric motor, wherein said at least electric motor connect to said least one electrical power source;

(e) at least one gear set, wherein said at least one electric motor engages with said at least one gear set;

(f) at least one electronic module, wherein said at least one electronic module controls the operation of said electric motor;

(g) at least one trigger, wherein at least one trigger connects to said at least one electronic module; and (h) at least one support base, wherein the at least one support base is coupled to the at least one wheel, the at least one support base is hollow and encases at least one gear set, the at least one gear set drives the at least one wheel between a first and a second position, wherein said at least one support base is an axle.

10. The abdominal roller according to claim 9, wherein said at least one trigger is a switch.

11. The abdominal roller according to claim 9, wherein said at least one trigger is a sensor.

12. The abdominal roller according to claim 9, wherein said at least one trigger is a mechanical force-sensitive device.

13. The abdominal roller according to claim 9, wherein said at least one electronic module can be programmed.

14. An abdominal roller comprising:

(a) at least one wheel;

(b) at least one handle, wherein said at least one handle further connected to a side of said at least one wheel;

(c) at least one electrical power source;

(d) at least one electric motor, wherein said at least electric motor connects to said least one electrical power source;

(e) at least one electronic module, wherein said at least one electronic module controls the operation of said electric motor; and (f) at least one gear set, wherein the at least one electric motor further engages with the at least one gear set, the at least one gear set drives the at least one wheel between a first and a second position, wherein said at least one gear set is encased within at least one support base, and said at least one support base is an axle.

15. The abdominal roller according to claim 14, wherein said at least one trigger interacts with said electronic module.

16. The abdominal roller according to claim 14, wherein said at least one support base is further coupled to the at least one wheel.

17. The abdominal roller according to claim 15, wherein said at least one trigger is switch.

18. The abdominal roller according to claim 15, wherein said at least one trigger is sensor.

* * * * *